US007238094B2

(12) United States Patent
Liu

(10) Patent No.: US 7,238,094 B2
(45) Date of Patent: Jul. 3, 2007

(54) BELT OSCILLATING APPARATUS OF BELT SANDER

(76) Inventor: John Liu, No. 31, Lane 272, Dalin Rd., Daya Township, Taichung County 428 (TW)

( * ) Notice: Subject to any disclaimer, the term of this patent is extended or adjusted under 35 U.S.C. 154(b) by 0 days.

(21) Appl. No.: 11/196,406

(22) Filed: Aug. 4, 2005

(65) Prior Publication Data

US 2007/0032181 A1 Feb. 8, 2007

(51) Int. Cl.
*B24B 21/00* (2006.01)

(52) U.S. Cl. ..... 451/304

(58) Field of Classification Search ..... 451/304
See application file for complete search history.

(56) References Cited

U.S. PATENT DOCUMENTS 1,628,531 A * 5/1927 Carlson ..... 451/304
2,220,268 A * 11/1940 Olsen ..... 451/6
3,447,306 A * 6/1969 Jakimcius ..... 451/544
3,552,067 A * 1/1971 Przygocki ..... 451/1
3,665,650 A * 5/1972 Przygocki ..... 451/1
3,745,717 A * 7/1973 Robinson ..... 451/1
3,900,973 A * 8/1975 van der Linden ..... 451/297
4,187,645 A * 2/1980 Lind ..... 451/297
4,290,240 A * 9/1981 Robinson ..... 451/297
4,369,601 A * 1/1983 Gerber ..... 451/297
5,871,390 A * 2/1999 Pant et al. ..... 451/5
6,386,958 B1 * 5/2002 Wang ..... 451/65
6,471,568 B1 * 10/2002 Wang ..... 451/168
6,899,594 B1 * 5/2005 Charatan et al. ..... 451/11

FOREIGN PATENT DOCUMENTS

EP 0312841 * 4/1989

* cited by examiner

*Primary Examiner*—M. Rachuba
(74) *Attorney, Agent, or Firm*—Troxell Law Office, PLLC

(57) ABSTRACT

A belt oscillating apparatus of a belt sander, wherein the belt sander includes a machine frame, a driving wheel, a driven wheel, a sand belt mounted on the driving wheel and the driven wheel, and the belt oscillating apparatus is mounted on the machine frame, comprising two oscillating devices, two transmission devices and a valve. The oscillating devices are pivoted on the machine frame and pivoting the driven wheel therebetween. The transmission devices connect the oscillating devices and the valve. A pneumatic power is provided to the valve to move the driven wheel via the transmissions and the oscillating device. The oscillating devices and the transmission device are working alternately by the sand belt touches the oscillating devices, such that the sand belt is reciprocated between the oscillating devices.

7 Claims, 4 Drawing Sheets

BELT OSCILLATING APPARATUS OF BELT SANDER

BACKGROUND OF THE INVENTION

1. Field of the Invention

The present invention relates generally to a belt sander, and more particularly to a belt oscillating apparatus of a belt sander.

2. Description of the Related Art

A conventional belt sander has a base, on which a driving wheel and a driven wheel are pivoted, a sand belt mounted on the driving and driven wheels, and a motor driving the driving wheel to rotate the sand belt, such that a workpiece is grinded on the running sand belt. The sand belt is worn when it grinds the workpieces. To keep the sand belt from being worn uniformly, the operator has to reciprocate the workpiece, and that make extra loading to the operator.

There are improved belt sanders with an oscillating device to reciprocate the sand belt, such that the operator only needs to hold the workpiece still. The conventional oscillating devices are complex and expensive that has less value for the industry.

SUMMARY OF THE INVENTION

The primary objective of the present invention is to provide a belt oscillating apparatus of a belt sander, which has a simple structure and lower cost.

According to the objective of the present invention, a belt oscillating apparatus of a belt sander, wherein the belt sander includes a machine frame, a driving wheel, a driven wheel, a sand belt mounted on the driving wheel and the driven wheel, and the belt oscillating apparatus is mounted on the machine frame, comprising two oscillating devices pivoted on the machine frame and pivoting the driven wheel therebetween to move the driven wheel along an axle of the driven wheel in a predetermined range. While the sand belt moves along with the driven wheel and touches one of the oscillating devices, the driven wheel is moved reversely to move the sand belt to the other oscillating device, such that the sand belt is reciprocated between the oscillating devices.

DETAILED DESCRIPTION OF THE INVENTION

Figure 1:
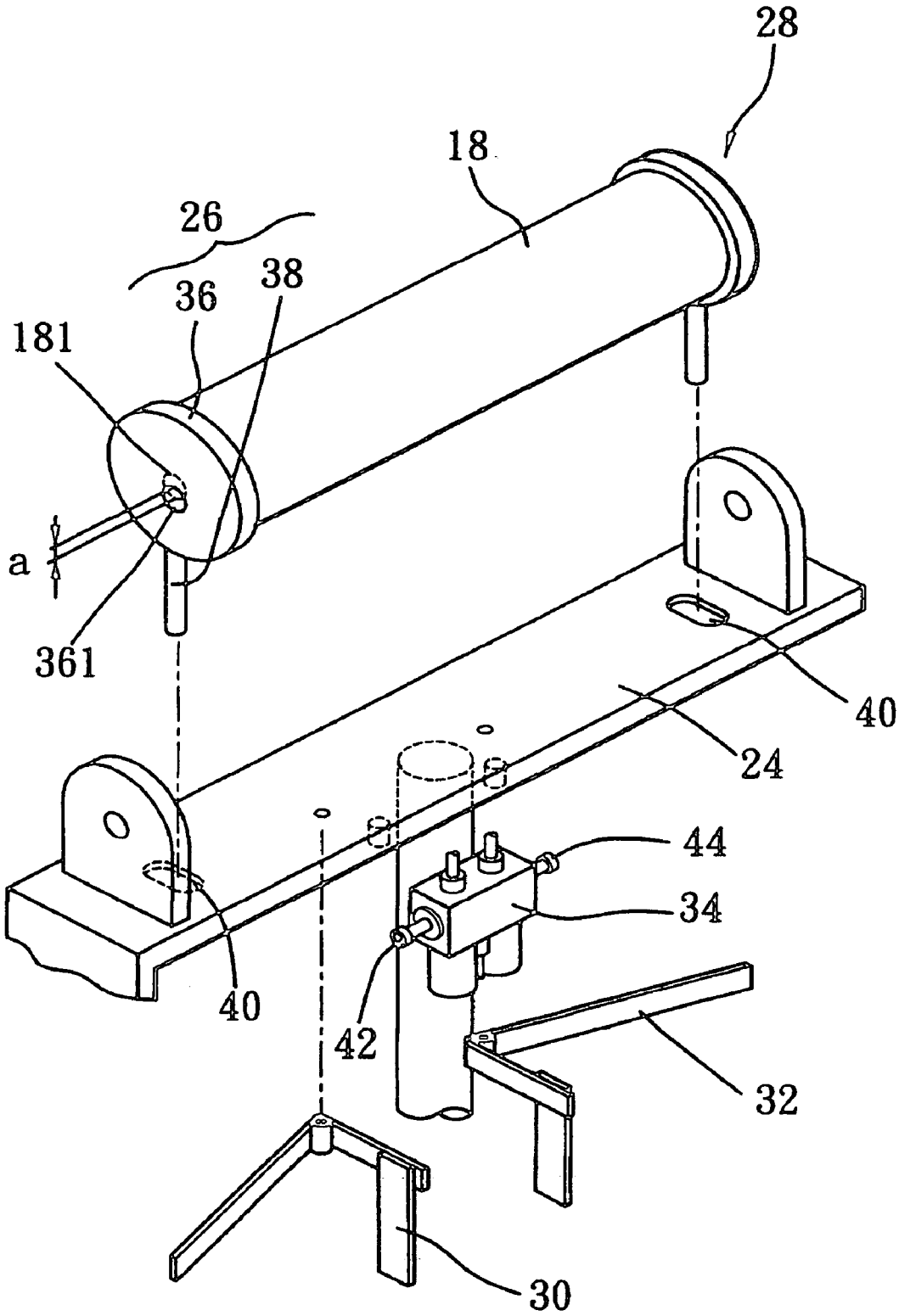
FIG. 1 is an exploded view of a preferred embodiment of the present invention.
Figure 2:
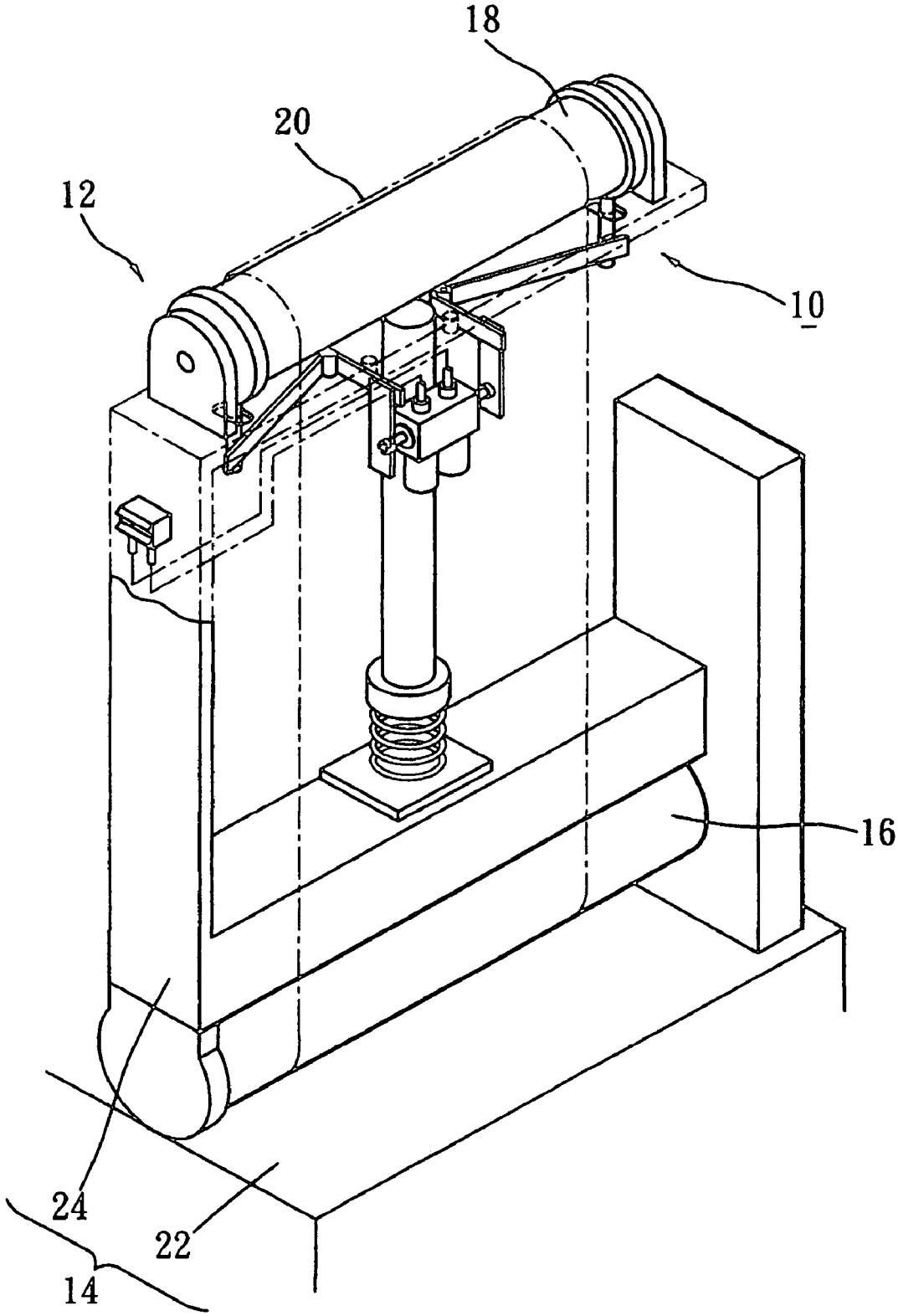
FIG. 2 is a perspective view of the preferred embodiment of the present invention, showing the belt oscillating device mounted on the belt sander.

As shown in FIG. 1 and FIG. 2, a belt oscillating apparatus 10 of the preferred embodiment of the present invention is mounted on a belt sander 12, and the belt sander 12 includes a machine frame 14, a driving wheel 16, a driven wheel 18, a sand belt 20 mounted on the driving and driven wheel 16 and 18, a motor to drive the driving wheel 16 and an air compressor (not shown). The elements of the belt sander 12 are as same as the conventional belt sander. The machine frame 14 includes a base member 22 and a frame 24. The driving wheel 16 is pivoted on the base member 22, and the driven wheel 28 is pivoted on the frame 24.

The belt oscillating apparatus 10 includes two oscillating devices 26 and 28, two transmission devices 30 and 32 and a valve 34. Each of the oscillating devices 26, 28 has a disk 36 and a pole 38 projected from a bottom of the disk 36. The disks 36 are pivoted on a top of the frame 24 for free swing. The driven wheel 18 is between the disks 36. There is a predetermined distance a between an axle 181 of the driven wheel 18 and pivot portions 361 of the disks 36, where is the frame 24 pivoted on. The poles 38 run through the frame 14 via openings 40. The transmission devices 30, 32 is pivoted on a bottom of the frame 24 and associated with the poles 38. The valve 34, which is a three-way, two-position valve, is mounted on the bottom of the frame to be connected to the air compressor. The valve 42 has two bars 42 and 44 associated with the transmission devices 30, 32 respectively.

Figure 3:
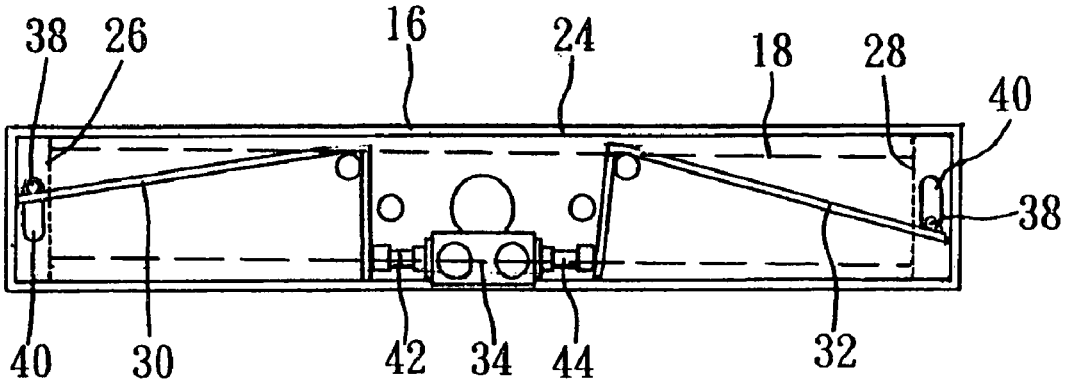
FIG. 3 and FIG. 4 are sketch diagrams of the preferred embodiment of the present invention, showing the action and relationship of the oscillating device, the transmission device and the driven wheel.
Figure 4:
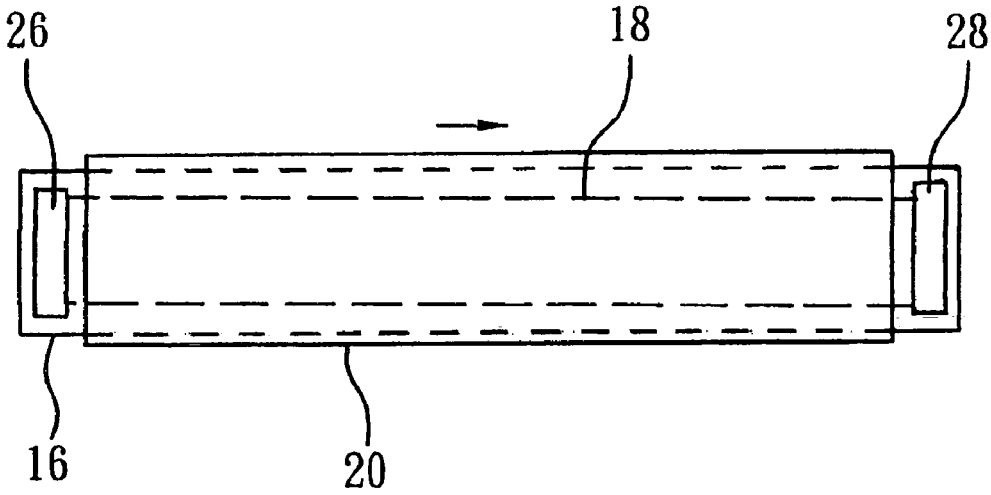

As shown in FIG. 3 and FIG. 4, when the belt sander 12 is not running, the compressed gas from the air compressor moves the bar 42 of the valve 34 to move the transmission device 30, and then, the transmission device 30 moves the pole 38 of the oscillating device 26 against an end of the opening 40. As a result, the driven wheel 18 is moved relative to the driving wheel 16 to move the sand belt 20 toward the oscillating device 28 when the sand belt 20 is running.

Figure 5:
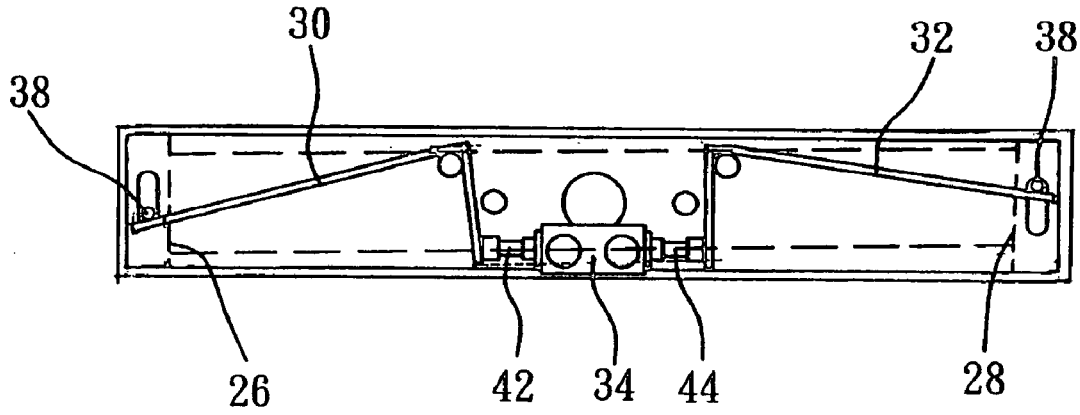
FIG. 5 and FIG. 6 are the sketch diagrams of the oscillating device, the transmission device and the driven wheel from another view.
Figure 6:
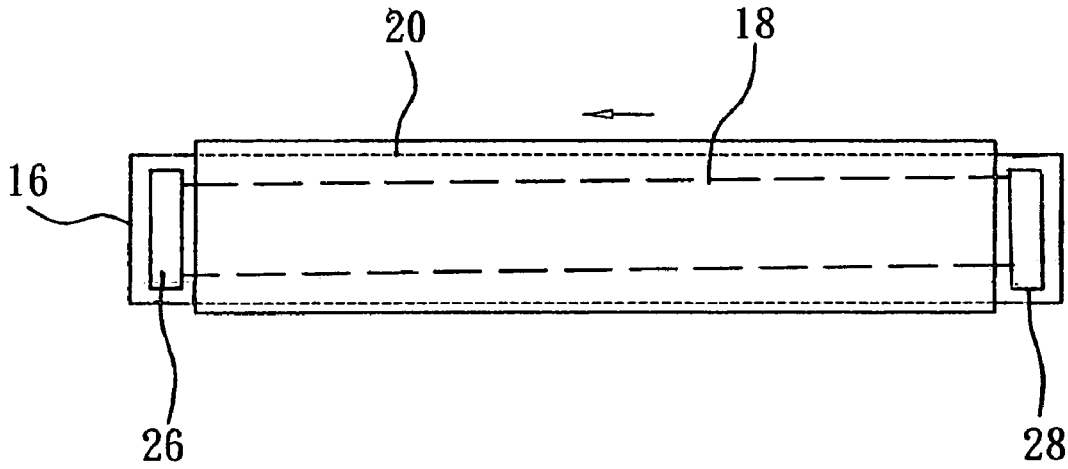

As shown in FIG. 5 and FIG. 6, when the sand belt 14 touches the oscillating device 28, the running sand belt 14 moves the oscillating device 28 for the pole 38 thereof moving to the other end of the opening 40. The transmission device 32 is moved by the pole 38 and pushes the bar 42 of the valve 38, and then, the valve 34 is activated to push the bar 44 outwards and to move the transmission device 36, the bar 44 and the oscillating device 28 reversely. As a result, the driven wheel 18 is moved reversely to move the sand belt 14 to the oscillating device 26.

In conclusion, the belt oscillating apparatus 10 of the present invention 10 provides the oscillating devices 26, 28, the transmission devices 30, 32 and the valve 34 working with each other to reciprocate the driven wheel 18 along the axle of the driving wheel 16, such that the sand belt 14 is reciprocated when the driving wheel 16 is running. As a result, the operator only needs to hold the workpiece still to grind it by the belt sander 10. It lowers loading of operator and elongates the life of the belt sander 10.

It has to be mentioned that the transmission devices may be connected to the bars of the valve directly. The transmission device is driven by one oscillating device to moves the other oscillating device. It still meets the scope of the present invention.

What is claimed is:

1. A belt oscillating apparatus of a belt sander, wherein the belt sander includes a machine frame, a driving wheel, a driven wheel, a sand belt mounted on the driving wheel and the driven wheel, and the belt oscillating apparatus is mounted on the machine frame, comprising two oscillating devices pivoted on the machine frame and pivoting the driven wheel therebetween to move the driven wheel along an axle of the driven wheel in a predetermined range, wherein while the sand belt moves along with the driven wheel and touches one of the oscillating devices, the driven wheel is moved reversely to move the sand belt to the other oscillating device, such that the sand belt is reciprocated between the oscillating devices, wherein each of the oscillating devices has a disk pivoted on the frame and on the ends of the driven wheel and a pole protected from a bottom of the disk.

2. The belt oscillating apparatus as defined in claim 1, wherein the machine frame has a base member, on which the driving wheel is pivoted, and a frame mounted on the base member, on which the driven wheel is pivoted.

3. The belt oscillating apparatus as defined in claim 1, wherein a distance is between an axial direction of the driven wheel and pivot portions of the disks where the frame is pivoted on.

4. The belt oscillating apparatus as defined in claim 1, further comprising two transmission devices provided on a bottom of the frame for rotation and associated with the poles of the oscillating devices respectively and a valve on the bottom of the frame with two bars associated with the transmission devices respectively.

5. The belt oscillating apparatus as defined in claim 4, wherein the bars of the valve is connected to ends of the transmission devices respectively.

6. The belt oscillating apparatus as defined in claim 4, wherein the frame has two openings, through which the poles are running respectively.

7. The belt oscillating apparatus as defined in claim 6, wherein the valve is a three-way, two-position valve.

* * * * *